US007040933B1

(12) United States Patent
Ma

(10) Patent No.: US 7,040,933 B1
(45) Date of Patent: May 9, 2006

(54) MODULAR COMMUNICATION JACK WITH LOW ASSEMBLING TOLERANCE

(75) Inventor: Tsu-Yuan Ma, Taipei (TW)

(73) Assignee: Hsing Chau Industrial Co., LTD, Taipei (TW)

( * ) Notice: Subject to any disclaimer, the term of this patent is extended or adjusted under 35 U.S.C. 154(b) by 0 days.

(21) Appl. No.: 11/118,887

(22) Filed: May 2, 2005

(51) Int. Cl.
*H01R 24/00* (2006.01)

(52) U.S. Cl. ..... 439/676

(58) Field of Classification Search ..... 439/676
See application file for complete search history.

(56) References Cited

U.S. PATENT DOCUMENTS 6,234,836 B1 * 5/2001 Schmidt et al. ..... 439/557
6,328,595 B1 * 12/2001 Chang ..... 439/490
6,350,156 B1 * 2/2002 Hasircoglu et al. ..... 439/676
6,508,677 B1 * 1/2003 Wang ..... 439/676
6,814,624 B1 * 11/2004 Clark et al. ..... 439/676
2002/0160662 A1 * 10/2002 Arnett et al. ..... 439/676

* cited by examiner

*Primary Examiner*—Tulsidas C. Patel
*Assistant Examiner*—Vladimir Imas
(74) *Attorney, Agent, or Firm*—Birch Stewart Kolasch & Birch LLP

(57) ABSTRACT

A modular communication jack with low assembling tolerance includes a circuit board being provided on a front portion with spring contact terminals for contacting with a communication plug, and on a rear portion with Insulation Displace Contact terminals for contacting with wire cores of a communication cable; an insulated inner housing assembled to a top of the circuit board to prevent the circuit board from moving in X-direction and Y-direction, and being formed at a front portion with a cavity for receiving a communication plug; an insulated bottom member assembled to a bottom of the circuit board and fixedly connected to the inner housing to sandwich the circuit board between the inner housing and the bottom member and further prevent the circuit board from moving in Z-direction; and an outer housing enclosing an assembly of the inner housing, the bottom member, and the circuit board therein.

4 Claims, 4 Drawing Sheets

MODULAR COMMUNICATION JACK WITH LOW ASSEMBLING TOLERANCE

FIELD OF THE INVENTION

The present invention relates to a communication jack, and more particularly to a modular communication jack that is easy to assemble and has low assembling tolerance.

BACKGROUND OF THE INVENTION

With the prosperous development of network communication, the flow of data increases quickly. To increase the bandwidth of signals, signals are transmitted at higher and higher frequencies. In the high-frequency transmission, signals are very sensitive to external interference. Therefore, users have more strict demands for the quality and precision of connectors used in network communication.

FIG. 1 is an exploded perspective view of a conventional communication jack 7, which mainly includes an outer housing 71, a plurality of spring contact terminals 74, a terminal support 73, a circuit board 72, two rows of insulation displace contact (IDC) terminals 751, and two IDC terminal seats 75. A corresponding communication plug may be inserted into the communication jack 7 for conductive terminals in the plug to contact with the spring contact terminals 74 in the jack. A recess 711 formed on the outer housing 71 serves as an insertion hole to hold the inserted communication plug in place. The spring contact terminals 74 are supported on the terminal support 73 and fixedly connected to the circuit board 72. The circuit board 72 is fixed to the outer housing 71 by means of retaining hooks 721. The conventional communication jack 7 includes a lot of components, which are assembled in multiple layers. Each assembling procedure is based on a lower layer of assembled components. Therefore, the completed communication jack 7 has a very large accumulated tolerance, which has adverse influence on the stable contact of the spring contact terminals with the conductive terminals on the communication plug, and accordingly, results in poor transmission quality.

SUMMARY OF THE INVENTION

A primary object of the present invention is to provide a modular communication jack, in which a circuit board forms a base of the communication jack and all other components of the communication jack are assembled to the circuit board, so that the communication jack has a largely reduced accumulated assembling tolerance.

To achieve the above and other objects, the modular communication jack with low assembling tolerance according to the present invention includes a circuit board being provided on a front portion with a plurality of spring contact terminals in a bent configuration, and on a rear portion with a plurality of Insulation Displace Contact (IDC) terminals; an insulated inner housing being assembled to a top of the circuit board to prevent the circuit board from moving in X-direction and Y-direction, and being formed at a front portion with a cavity to serve as an insertion hole for receiving a communication plug therein; an insulated bottom member assembled to a bottom of the circuit board and fixedly connected to the insulated inner housing, so that the circuit board is sandwiched between the inner housing and the bottom member and further prevented from moving in Z-direction; and an outer housing for enclosing an assembly of the inner housing, the bottom member, and the circuit board therein.

In this manner, the circuit board forms a base of the communication jack with all other components of the communication jack assembled to the circuit board, enabling the communication jack to have a largely reduced accumulated assembling tolerance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
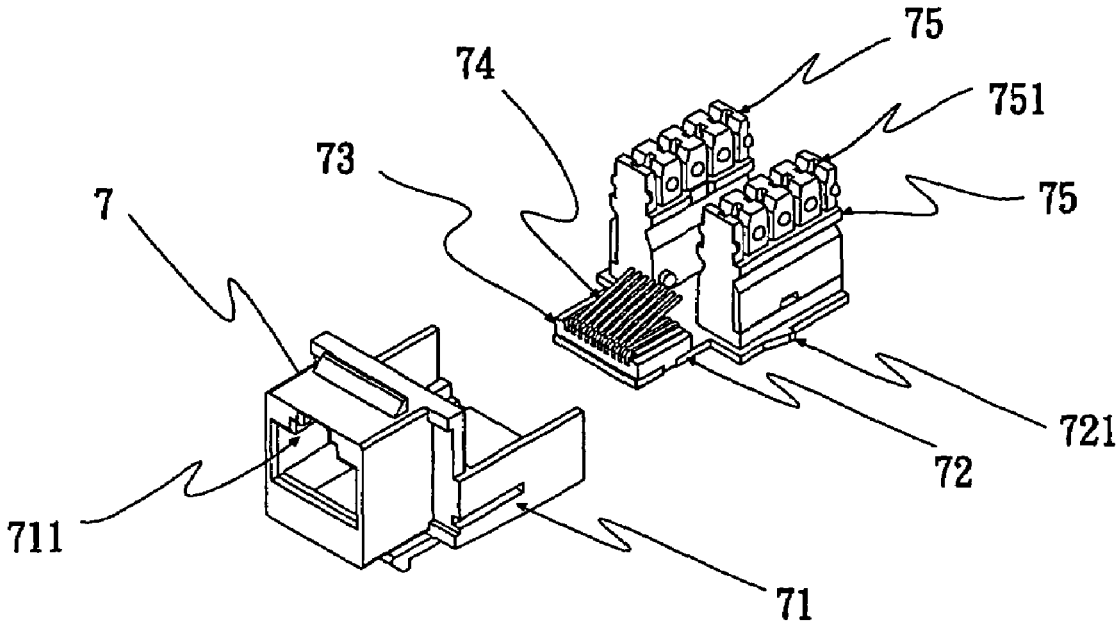
(PRIOR ART) Fig. 1
FIG. 1 is an exploded perspective view of a conventional communication jack.
Figure 2:
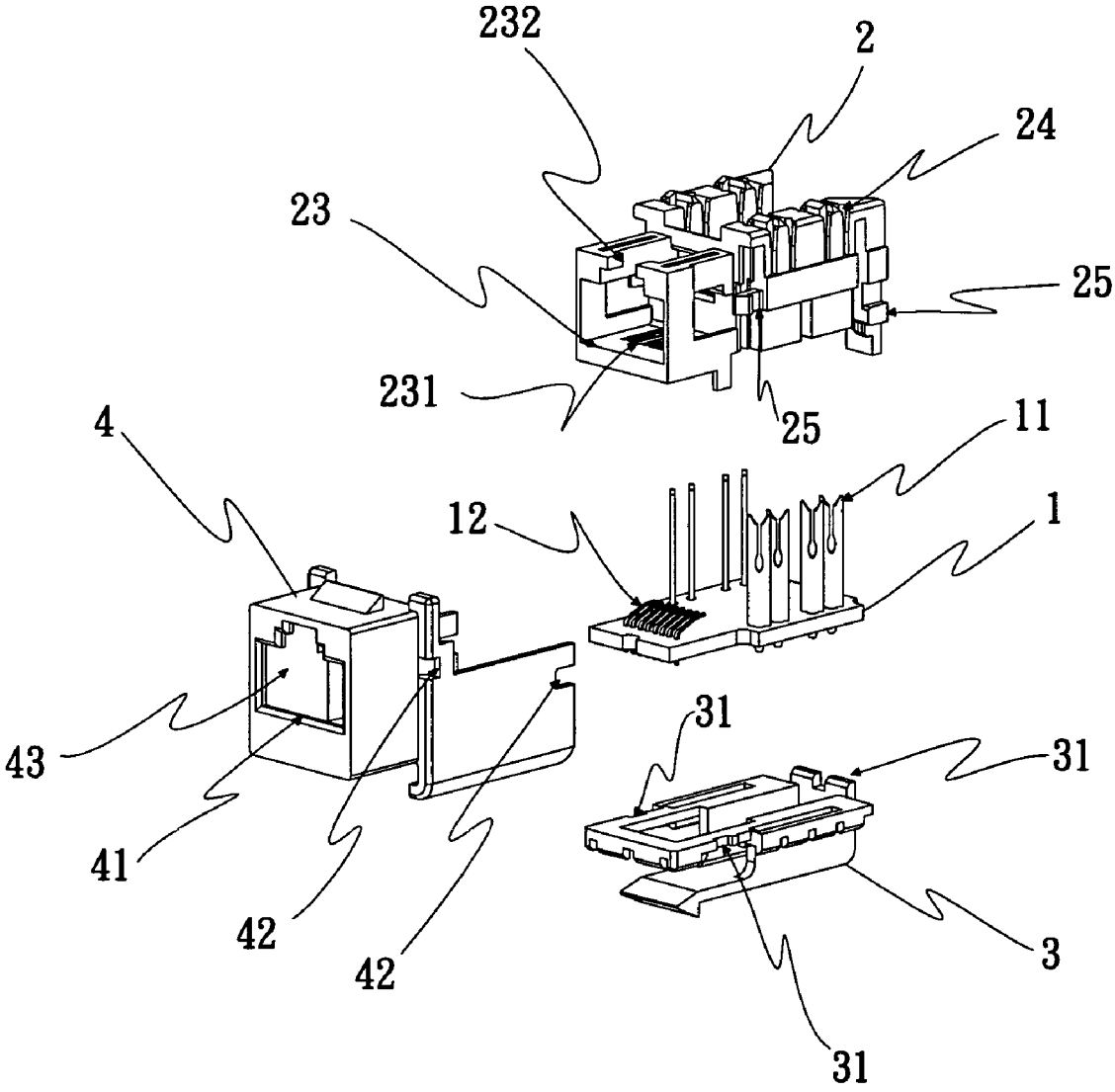
FIGS. 2 and 3 are top and bottom exploded perspective views, respectively, of a modular communication jack according to the present invention.
Figure 3:
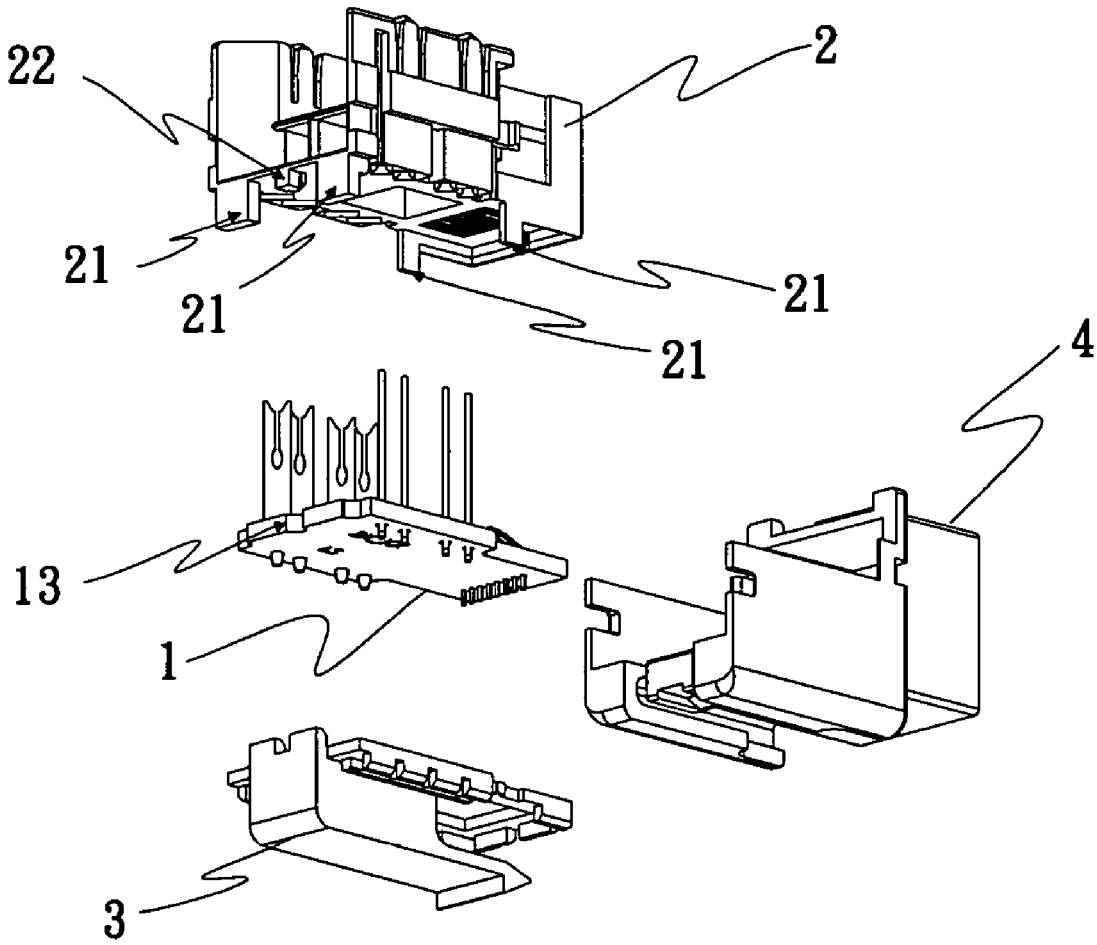

Please refer to FIGS. 2 and 3 that are top and bottom exploded perspective views, respectively, of a modular communication jack with low assembling tolerance according to the present invention. For the purpose of conciseness, the present invention is also briefly referred to as the communication jack throughout the specification thereof. As shown, the communication jack of the present invention mainly includes a circuit board 1, an insulated inner housing 2, an insulated bottom member 3, and an outer housing 4.

The circuit board 1 is provided on a front portion with a plurality of spring contact terminals 12 in a bent configuration, and on a rear portion with a plurality of insulation displace contact (IDC) terminals 11. Conducting circuits are provided on the circuit board 1. However, a soft circuit board or a sheet metal may also be used to replace the circuit board 1 to achieve the same electrical conducting function.

The insulated inner housing 2 is assembled to a top of the circuit board 1 through engagement of posts 22 below the insulated inner housing 2 with round openings 13 on outer edges of the circuit board 1 (see FIG. 3), so that the circuit board 1 is prevented from moving in X-direction and Y-direction relative to the insulated inner housing 2. The round openings 13 on the circuit board 1 may be replaced with semicircular openings. The insulated inner housing 2 is provided at a front portion with a cavity 23 to serve as an insertion hole for receiving a communication plug. The communication jack is of an RJ-45 jack (Registered Jack-45), and the cavity or insertion hole 23 of the communication jack is formed at a bottom with a plurality of openings 231 corresponding to the spring contact terminals 12 on the circuit board 1, such that the spring contact terminals 12 are upward exposed and protruded from the bottom of the cavity 23 via the openings 231. The insulated inner housing 2 is provided at a rear portion with a plurality of through holes 24, via which the IDC terminals 11 are upward extended through the insulated inner housing 2.

The insulated bottom member 3 is assembled to a bottom of the circuit board 1, and is fixedly connected to the insulated inner housing 2 through engagement of upward locating structures 31 provided on the bottom member 3 with downward flat guiding structures 21 provided below the inner housing 2, such that the circuit board 1 is sandwiched between the insulated bottom member 3 and the insulated inner housing 2 and further prevented from moving in Z-direction relative to the inner housing 2 and the bottom member 3.

The outer housing 4 is provided at a front end with an opening 41 having a configuration corresponding to an RJ-45 communication jack, and defines an inner receiving space 43 that encloses and fixes an assembly of the insulated inner housing 2, the insulated bottom member 3, and the sandwiched circuit board 1 therein. The circuit board 1 forms a base of the communication jack with all other components of the communication jack assembled to the circuit board 1. In this manner, the communication jack of the present invention has a largely reduced accumulated assembling tolerance.

Figure 4:
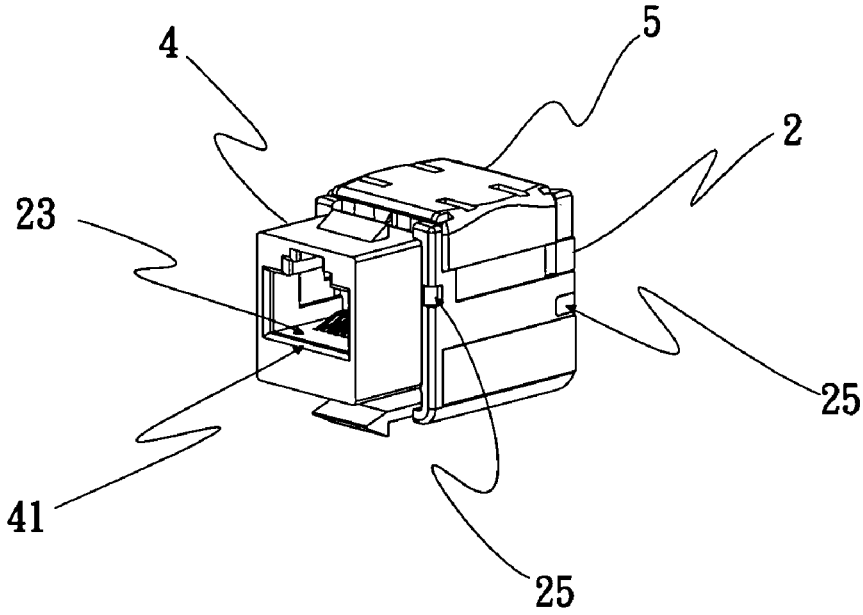
FIG. 4 is an assembled perspective view of the modular communication jack according to the present invention.

Please refer to FIG. 4 that is an assembled perspective view of the communication jack of the present invention. As shown, the assembly of the insulated inner housing 2, the insulated bottom member 3, and the circuit board 1 is enclosed in the outer housing 4. The insulated inner housing 2 is further connected to the outer housing 4 through engagement of locating projections 25 with locating notches 42 correspondingly formed on the outer housing 4 (see FIG. 2). A top cover 5 is then closed onto a top of the insulated inner housing 2 to complete the communication jack of the present invention.

Figure 5:
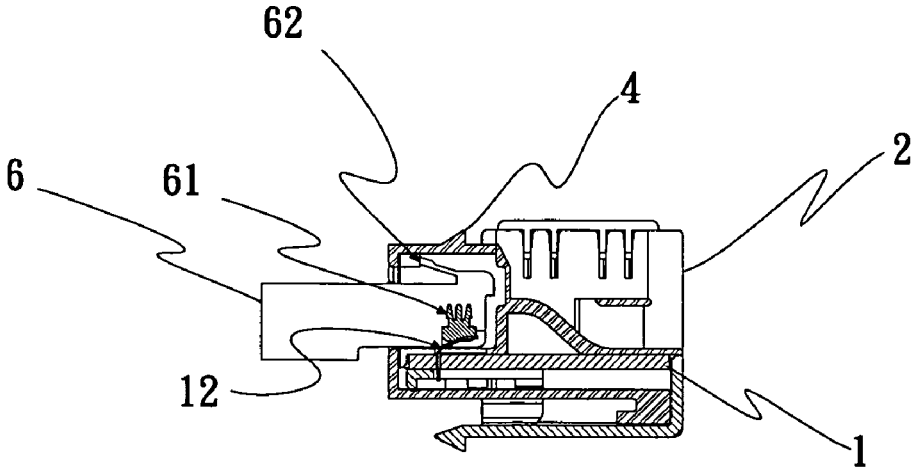
FIG. 5 is a sectioned side view of the modular communication jack of FIG. 4 with a communication plug inserted thereinto.

Please refer to FIG. 5 that is a sectioned side view of FIG. 4. When a communication plug 6 is inserted into the cavity 23 in the insulated inner housing 2 via the RJ-45-shaped opening 41 at the front end of the outer housing 4, an elastic retaining point 62 on the communication plug 6 engages with protrusions 232 in the cavity 23 (see FIG. 2) to hold the communication plug 6 in the cavity 23 of the insulated inner housing 2 without the risk of easy separation of the communication plug 6 from the inner housing 2. At this point, conductive terminals 61 on the communication plug 6 are in electrical contact with the spring contact terminals 12 on the front portion of the circuit board 1.

With the above arrangements, the communication jack of the present invention has an effectively reduced accumulated assembling tolerance to enable a stable contact of the communication jack with the communication plug, and accordingly an upgraded transmission quality.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A module communication jack with low assembling tolerance, comprising:

a circuit board being provided on a front portion with a plurality of spring contact terminals in a bent configuration, and on a rear portion with a plurality of insulation displace contact (IDC) terminals;

an insulated inner housing assembled to a top of said circuit board and having downward projected structures to prevent said circuit board from moving in a horizontal direction with respect to said insulated inner housing; said insulated inner housing is provided with a plurality of protrusions and a cavity to serve as an insertion hole for receiving a communication plug, a plurality of openings being formed in said cavity in order to locate the spring contact terminals;

an insulated bottom member assembled to a bottom of said circuit board and fixedly connected to said insulated inner housing through engagement of upward locating structures provided on a said insulated bottom member with downward flat guiding structures provided below said insulated inner housing, such that said circuit board is located between said insulated bottom member and said insulated inner housing so that said circuit board is prevented from moving in up and down direction with respect to said inner housing and said bottom member; and an outer housing defining an inner receiving space to enclose and fix an assembly of said insulated inner housing, said insulated bottom member, and said circuit board therein.

2. The module communication jack with low assembling tolerance as claimed in claim 1, wherein said spring contact terminals provided on the front portion of said circuit board are upward exposed and protruded from a bottom of said cavity at the front portion of said insulated inner housing.

3. The module communication jack with low assembling tolerance as claimed in claim 1, wherein said circuit board is a soft circuit board.

4. The module communication jack with low assembling tolerance as claimed in claim 1, wherein said circuit board is in the form of a sheet metal.

* * * * *